US006000986A

United States Patent [19]

Kaufman

[11] Patent Number: 6,000,986

[45] Date of Patent: Dec. 14, 1999

[54] INTERACTIVE BOOK

[75] Inventor: Shari Kaufman, Westport, Conn.

[73] Assignee: Innovative USA, Inc., Stamford, Conn.

[21] Appl. No.: 09/149,780

[22] Filed: Sep. 8, 1998

Related U.S. Application Data

[60] Division of application No. 08/866,980, Jun. 2, 1997, Pat. No. 5,868,599, which is a continuation-in-part of application No. 08/812,931, Mar. 5, 1997, Pat. No. 5,764,581.

[51] Int. Cl.[6] ..... A63H 33/38; A63H 18/00; B42D 15/00

[52] U.S. Cl. ..... 446/147; 446/444; 283/63.1

[58] Field of Search ..... 446/71, 73, 147, 446/148, 444–447; 281/29; 283/63.1, 64; 238/10 R, 10 A

[56] References Cited

U.S. PATENT DOCUMENTS

| | | | |
|---|---|---|---|
| Re. 23,949 | 2/1955 | Matthaeis . | |
| 698,603 | 4/1902 | Wiederseim . | |
| 1,009,687 | 11/1911 | Patton . | |
| 1,490,295 | 4/1924 | Stephens . | |
| 1,914,116 | 6/1933 | Ford . | |
| 3,206,887 | 9/1965 | Eyler et al. | 46/17 |
| 3,589,064 | 6/1971 | Harada | 46/243 |
| 4,365,438 | 12/1982 | Nelson . | |
| 4,455,783 | 6/1984 | Nagano | 446/71 |
| 4,537,577 | 8/1985 | Sansome et al. | 446/445 |
| 4,673,182 | 6/1987 | Bowen | 273/110 |
| 4,708,348 | 11/1987 | Zaruba et al. | 273/246 |
| 4,898,404 | 2/1990 | Babcock | 281/15.1 |
| 4,990,117 | 2/1991 | Yonezawa | 446/126 |
| 5,112,052 | 5/1992 | Yamaura | 273/153 R |
| 5,232,154 | 8/1993 | Jenkins et al. | 238/10 F |
| 5,440,996 | 8/1995 | Cottino | 104/47 |
| 5,460,414 | 10/1995 | Sargis | 281/38 |
| 5,813,351 | 9/1998 | Chen | 104/60 |

OTHER PUBLICATIONS

Rule 1.56 Declaration of Michael Levins, 1996.

Zieh und Sieh, 1995 Teeney Books, Ltd. England, 1995.

*Primary Examiner*—D Neal Muir

*Assistant Examiner*—Laura Fossum

*Attorney, Agent, or Firm*—Hedman, Gibson & Costigan, P.C.

[57] ABSTRACT

An interactive book comprising at least one page comprising a track formed on said page, said page further comprising a fold out portion, said fold out portion comprising a track disposed thereon, whereby the tracks on said page and fold out portion cooperate to provide increased trackage area, a toy or figure wherein the toy or figure is movably engable on said track to move continuously from said page to said fold out portion.

12 Claims, 8 Drawing Sheets

INTERACTIVE BOOK

The present application is a divisional of U.S. Ser. No. 08/866,980, filed on Jun. 2, 1997, now U.S. Pat. No. 5,868,599 which in turn is a continuation-in-part of U.S. Ser. No. 08/812,931, filed Mar. 5, 1997, now U.S. Pat. No. 5,764,581.

FIELD OF THE INVENTION

The present invention relates to an interactive book having pages that include a track for accomodating a toy.

BACKGROUND OF THE INVENTION

Interactive books are well known in the art. One example of such a book is described in U.S. Pat. No. 4,425,098 (Doring), which discloses a sound illustrated book including sound record areas in the form of a spiral sound groove each associated with individual pages. Another such book is described in U.S. Pat. No. 4,378,118 (Leonardi), which discloses a game using a book as an organized picture generating element, the book illustrating interaction between objects controlled by the players of the game. U.S. Pat. No. 4,537,576 (Thorsheim) discloses an educational book providing interaction between graphic information contained on reference elements rotatably attached to a base leaf and a second set of graphic information contained on apertured leaves, so that superimposition of an apertured leaf and a base leaf visually align the reference elements.

U.S. Pat. No. 4,640,512 (Burke) discloses an interactive instructive book which guides the reader, using consecutively arranged indicia, in the assembly of a puzzle which is provided separate from the book. U.S. Pat. No. 5,226,822 (Morris) discloses an interactive electronic game book having a plurality of pages, the plurality of pages forming a game board for a game and including graphic information and instructions for playing the game represented on the game board, and an electronic randomizer to indicate the instructions to be used in playing the game.

U.S. Pat. No. 5,387,107 (Gunter et al.) discloses a personalized interactive storybook and method of teaching a reader a desired behavioral pattern by using text accompanied by a likeness of the reader. U.S. Pat. No. 5,413,486 (Burrows et al.) discloses an interactive book having a mechanism for generating a plurality of sensory outputs corresponding to visual indicia on the page of a book.

None of these devices provide an innovative interactive book the pages of which have text and/or graphical illustrations and tracks or monorails for guiding a toy or figure along the page.

SUMMARY OF THE PRESENT INVENTION

Accordingly, it is an object of the present invention to provide an interactive book that accommodates, through the use of a track or monorail, the movement of a toy or figure on the pages of the book.

It is a another object of the present invention to provide an educational interactive book that teaches the reader to associate the use of the toy or figure with the text of the book.

It is a further object of the present invention to provide an educational interactive book which assists in the development of the hand-eye coordination of the reader.

It is a still further object of the present invention to create an interest in reading in young readers by associating a toy or figure with a book.

The present invention comprises an interactive book having a plurality of pages containing text, illustrations and/or graphics, and at least one track or monorail for guiding the movement of toys or figures along the page, and at least one toy or figure for moving along the track or monorail.

The interactive book of the present invention comprises at least one page of text and/or graphics/illustrations, the page containing a track or monorail, a cover comprising a front, back and spine, a means for binding the pages and cover back together into a book, and a toy or figure for moving along the track. The pages of the book are of sufficient thickness and stiffness to accommodate the track contained therein on one or both sides of the page and the weight of toys or figures moving along the track.

Preferably the pages are constructed of a cardboard material ranging from about ⅛ to about ¼ inch, although other sturdy materials of construction known to those of ordinary skill in the art, such as plastic or rubber materials, may be employed in the practice of the present invention. The binding means is any conventional book binding means, including but not limited to, glue, string, spiral wire, three ring, etc.

BRIEF DESCRIPTION OF THE DRAWINGS

Other objects and advantages of this invention may be seen from the following description when viewed in conjunction with the accompanying drawings wherein.

DESCRIPTION OF THE PREFERRED EMBODIMENTS

The following description of the preferred embodiments is presented to illustrate the present invention and is not to be construed to limit the scope of the appended claims in any manner whatsoever.

Figure 1:
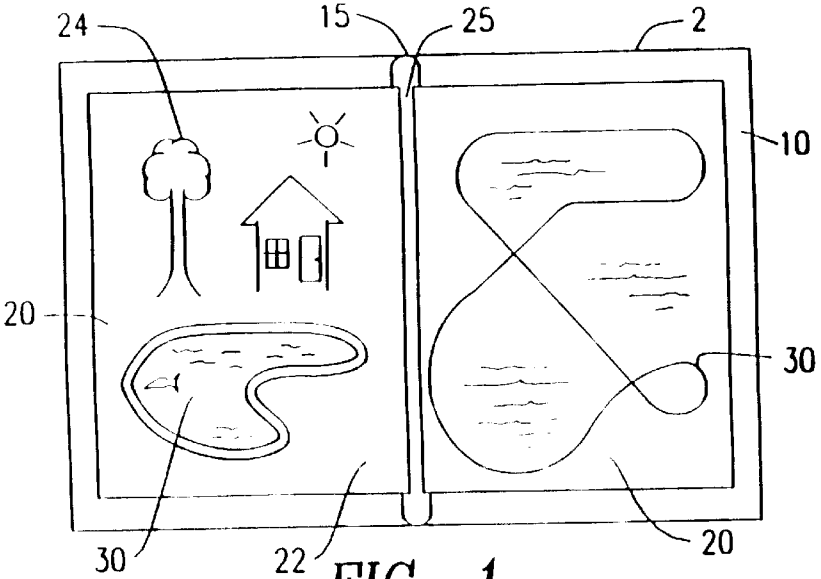
FIG. 1 is a top plan view of the bound book opened to opposite pages.
Figure 6A:
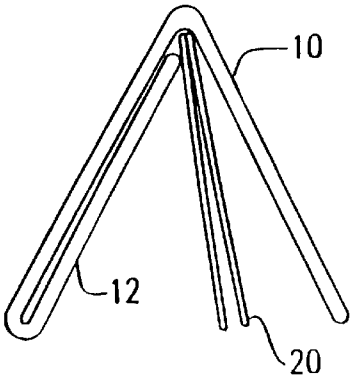
FIG. 6*a* depicts a top view of a preferred embodiment of the invention wherein the cover of the book includes a fold out section in a folded state.
Figure 6B:
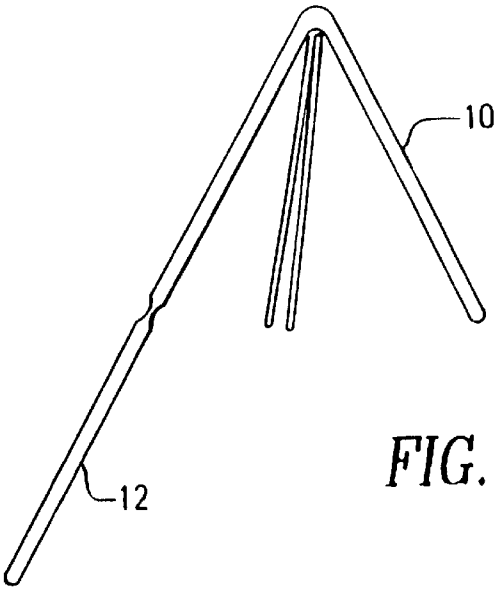
FIG. 6*b* depicts a top view of a preferred embodiment of the invention wherein the cover of the book includes a fold out section in the unfolded state.

Referring to FIG. 1, an embodiment of the book 2 is comprised of a cover 10, spine 15, a plurality pages 20 and binding means 25.

In a preferred embodiment (not shown), the pages 20 are removable from the binding means 25 when the binding means is a ring binder or other conventional binding means that allows for page removal.

Pages 20 comprise one or more sheets of cardboard or similar material of sufficient thickness and stiffness to accommodate the track 30 formed on the surface of one or both sides of pages 20. Now referring to FIGS. 1 and 4, track 30 comprises a groove or channel formed on one side of one of the pages 20. Track 30 can cross from one of pages 20 to an opposite page 20 across the spine 15 of book 2. In another embodiment, track 30 comprises a groove or channel which is formed in both sides of one of the pages 20, thereby forming a groove or channel which can be used on each side of said page 20. Track 30 can be a closed loop comprising a perpetual track or can be unclosed.

Figure 13B:
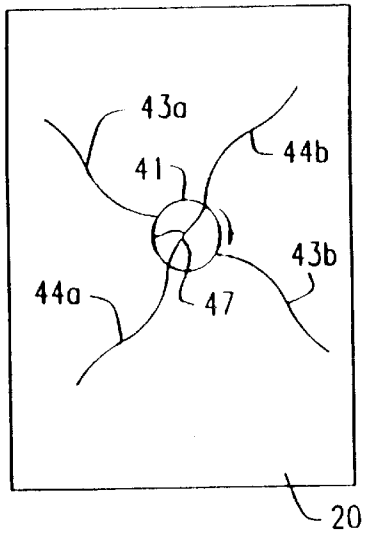
FIGS. 13*a*–13*d* are top views of other embodiments of the present invention showing the use of a switching means.
Figure 13A:
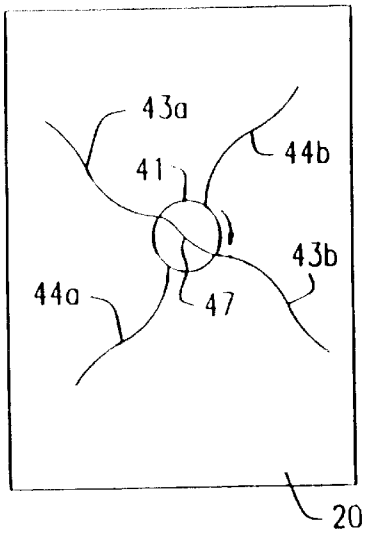
Figure 13D:
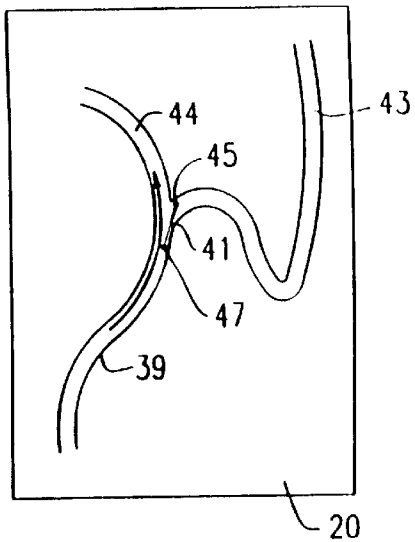
Figure 13C:
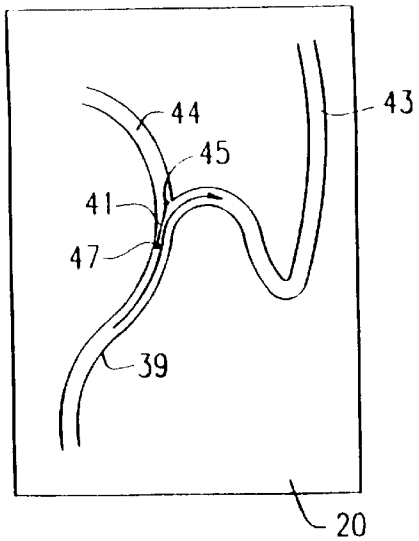

In another preferred embodiment, referring to FIGS. 13*a*–13*d*, the track 30 may include a switching means 41 which would enable the toy or figure 40 to switch from a first track 43 to a second track 44. Any of the switching means known to those of ordinary skill in the art are contemplated for use in the practice of the present invention. For example, in FIGS. 13*a* and 13*b*, a circular disc 41 having a track portion 47 which can rotate from providing connection for the first track portion 43*a* and 43*b*, to providing connection for the second track portions 44*a* and 44*b*. In FIGS. 13*c* and 13*d* there is shown a lever 41 with a tab 47 which hinges on hinge means 45 which can be moved to direct the toy from a first track 39 to either of tracks 43 or 44.

Figure 8:
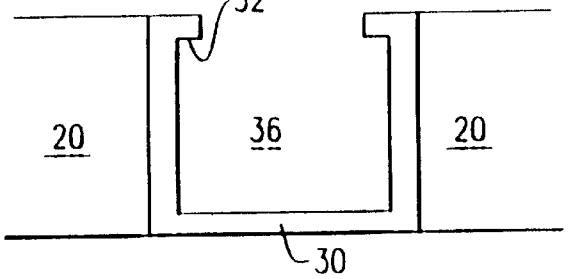
FIG. 8 is a front view of a cross section of track wherein the track is a flanged groove.
Figure 9:
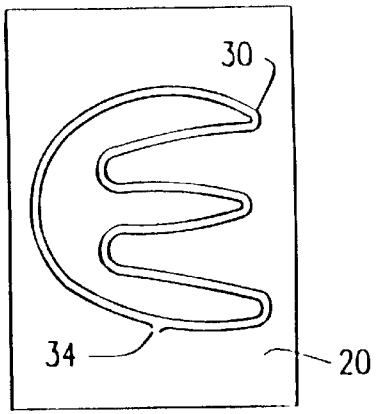
FIG. 9 is a top plan view of a track having a key notch.
Figure 7A:
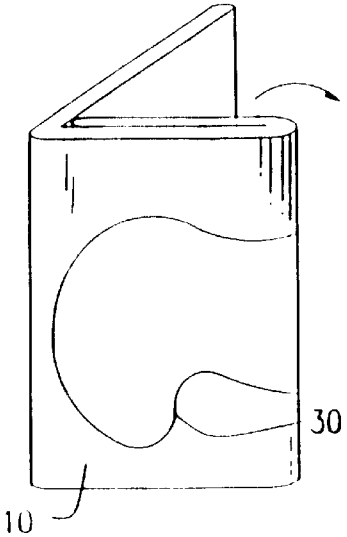
FIG. 7*a* is a front view of a preferred embodiment of the invention wherein the cover of the book having a foldout section is in a folded state.
Figure 7B:
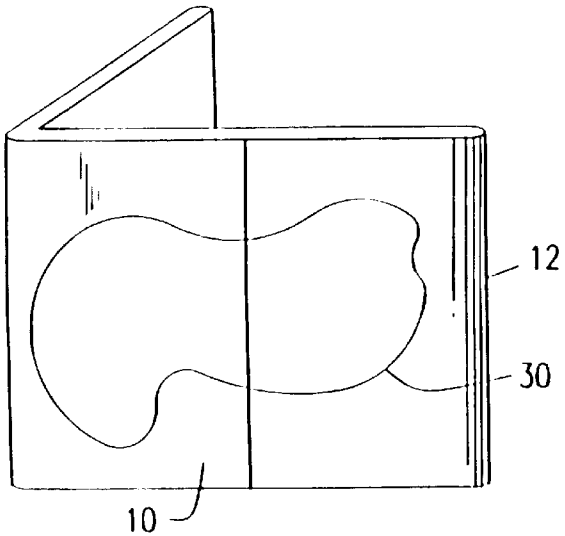
FIG. 7*b* is a front view of a preferred embodiment of the invention wherein the cover of the book is folded out to provide increased trackage area.
Figure 10:
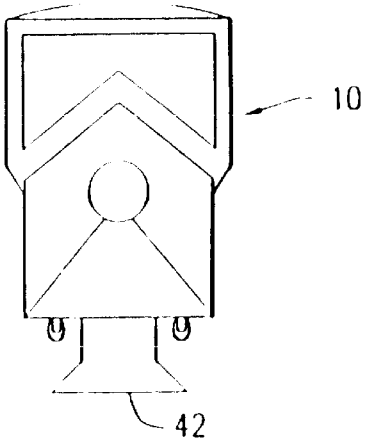
FIG. 10 is front view of a preferred embodiment of the invention wherein the toy or figure employs a modified guide means for engaging a track comprising a flanged groove.

Now referring to FIGS. 8–10, in still a further embodiment, track 30 comprises a flanged groove 36 including flange 32 and key notch 34 wherein flange 32 slidingly engages guide 42, which employs an engagement means such as but not limited to a flange, of toy or FIG. 40 and key notch 34 operates to allow introduction of guide 42 into engagement with flanged groove 36.

Alternatively, the present invention also contemplates embodiments wherein the track 30 provides for entry of the toy or figure 40 by providing an opening to the track at the edge of the page wherein the toy may be inserted into the track flanged groove. Still further, it is contemplated herein that where the flange 32 of the track 30 and the guide 42 of the toy 40 are constructed of flexible materials, the toy may be pressed directly into the flanged groove 36.

In this manner toy or figure 40 is securely engaged in track 30 and can travel along track 30 even when the page or cover 10 on which the track 30 is disposed is not on a horizontal plane, i.e., is tilted.

Figure 12A:
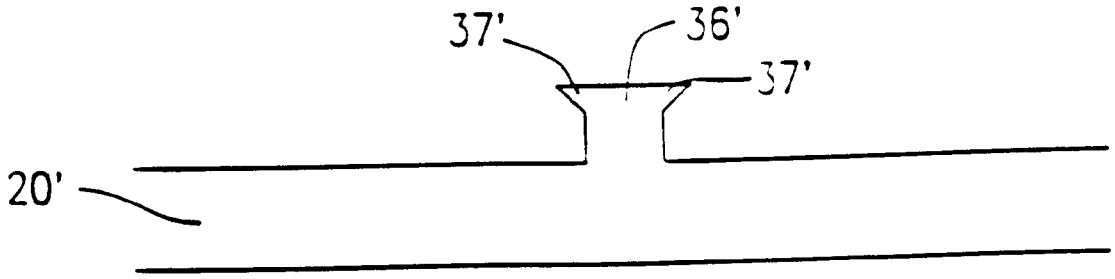
FIG. 12*a* is a front view of a cross-section of a page of a book of the present invention with a flanged monorail track.
Figure 12B:
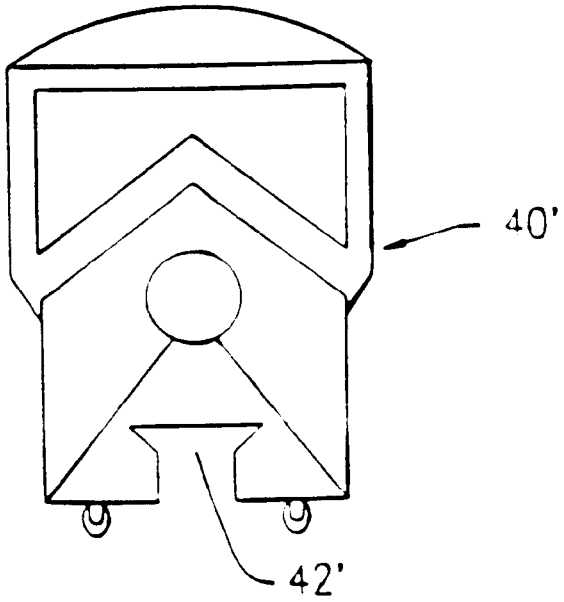
FIG. 12*b* is a front view of an embodiment of toy useful with the present invention which employs a modified guide means for engaging a track comprising a flanged monorail as shown in FIG. 12*a*.

Referring to FIGS. 12*a* and 12*b* there is shown another embodiment wherein the track on the page 20' comprises a flanged monorail 36'. The monorail portion 36' may be separately attached to the page 20' by use of an adhesive or it may be integrally formed with the page such as by diecutting. The toy 40' is provided with a space 42' which is designed to cooperate with the flanged monorail 36'. As stated above with respect to FIGS. 8–10, means may be provided for facilitating engagement of the toy 40' with monorail 36' such as an entry point on the monorail 36' which does not have flange portions 37', or the extension of the monorail 36' to the end of the page, or by use of flexible materials of construction.

In another embodiment (not shown) track 30 comprises a magnetic strip and toy 40 comprises a sheet of metal on the portion where it engages track 30.

Figure 5:
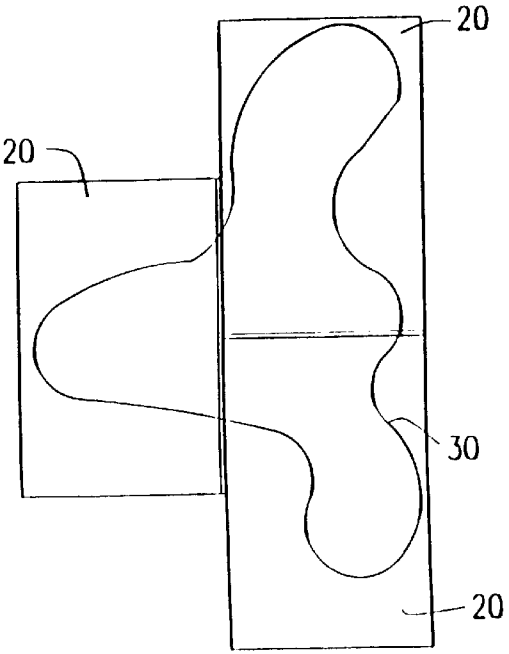
FIG. 5 depicts a top plan view of a preferred embodiment of the invention wherein the pages of the book are removable and can be arranged to cooperate to form a continuous track in a puzzle-like manner.

Turning now to FIG. 5, in another embodiment of the present invention pages 20 are removable from book 2. In this embodiment selected pages 20 can be removed and aligned next to each other to link unclosed sections of track 30 to form larger unclosed track sections or closed loops. In this regard, the pages 20 may optionally be provided with a hitching means or locking means (not shown), such as but not limited to snaps, clips, velcro or other mechanical means, to secure or lock the pages 20 together to prevent movement between the pages 20 in order that the track 30 remains continuous.

Alternatively, pages 20 or covers 10 from more than one book can be arranged in a similar fashion in order to enable the toy or figure 40 to cross over from the page 20 or cover 10 of one book 2 to the page 20 or cover 10 of a second book 2. Again, a hitching or locking means may be provided to secure the separate pages 20 or covers 10 to one another.

Figure 14:
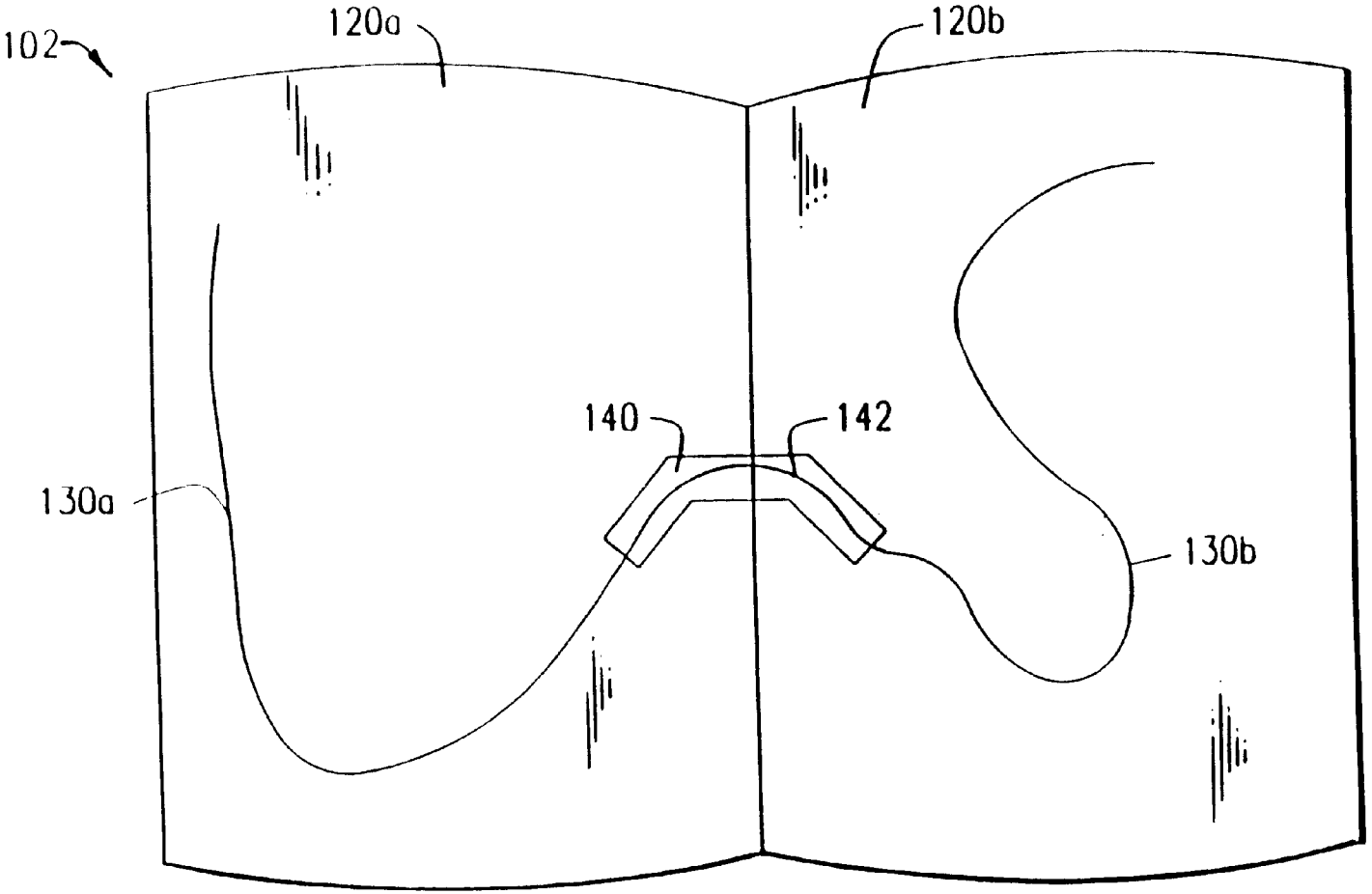
FIG. 14 is a top view of an additional embodiment of the present invention.

In another embodiment, the present invention may further provide for the use of pop-out bridging means with tracks provided thereon. Pop-out structures in books are well known and any of the means of providing the pop-out may be employed in accordance of the present invention. Referring to FIG. 14, there is shown a book 102 opened to two opposing pages 120*a* and 120*b*. Each page has a track associated therewith, 130*a* and 130*b*, respectively. The tracks 130*a* and 130*b* are joined by the use of a pop-out bridge 140 with track 142 thereon. The bridge is generally of a sturdy cardboard construction (although other sturdy materials may be employed). The entire bridge may pop-out from a single page, or about half of the bridge may pop-out from both pages. A connecting means may also be provided where necessary. Alternatively, a bridge which is not a pop-out, but a separate piece, may be provided to connected tracks 130*a* and 130*b*.

Of course it is within the practice of the present invention to provide a pop-out bridge or tunnel which is on a single page to further enhance the enjoyment of the books of the present invention.

Now referring to FIGS. 6*a*–7*b*, in a preferred embodiment cover 10 includes a fold out portion 12 which folds out to reveal a track 30 disposed thereon. A similar fold out portion 12 can be used in connection with one or more of pages 20 (not shown). Additionally, the pages may fold out in any direction, such as from the top or the bottom.

Figure 11B:
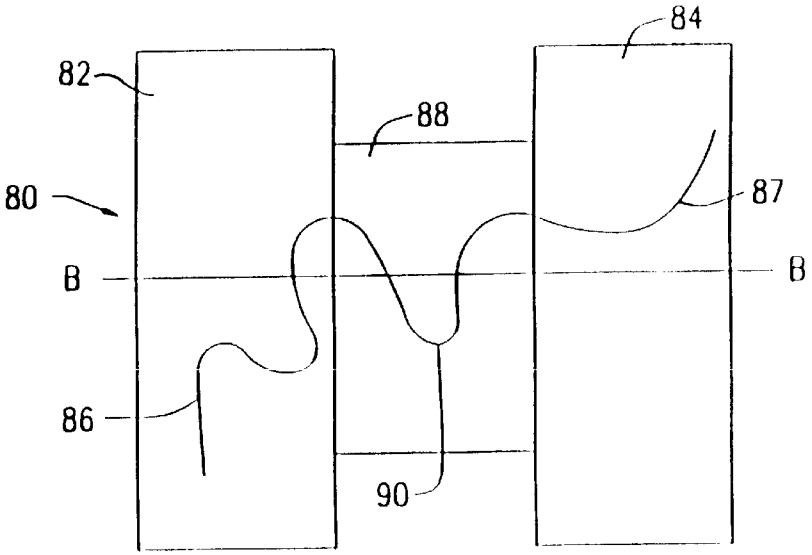
FIG. 11*b* is a top view of a page of a telescoping page embodiment of the present invention in the telescoped position.
Figure 11A:
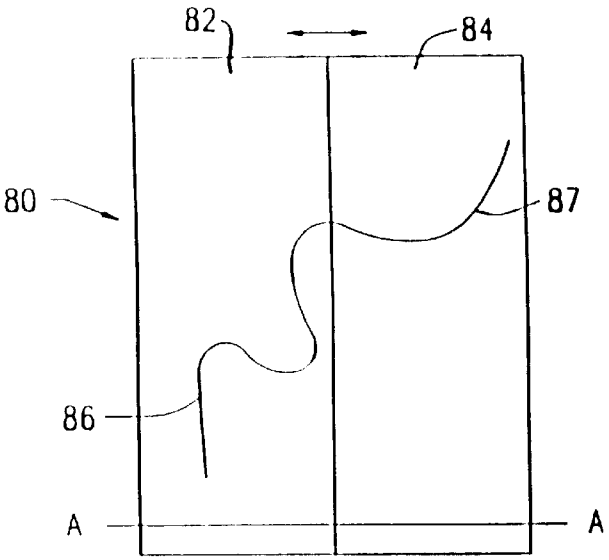
FIG. 11*a* is a top view of a page of a telescoping page embodiment of the present invention in the non-telescoped position.

In another preferred embodiment, referring to FIGS. 11*a*–11*e*, one or more pages 80 may be provided with a means for telescoping the edges of the pages 80 to enlarge the surface area of the page 80. In FIG. 11*a* the page 80 is seen from a top view in the closed position as comprising a first panel 82 and a second panel 84. Track 86 on first panel 82 cooperates with track 87 on second panel 84 to form a single continuous track.

In FIG. 11*b* the page 80 is seen from the top view in the opened position. Panels 82 and 84 are slidably engagable with a third interior panel 88. In this manner, the track 86 of panel 82 cooperates with the track 90 of thrid panel 88, which in turn cooperates with the track 87 of second panel 84 to form a single elongated continous track.

Figure 11E:
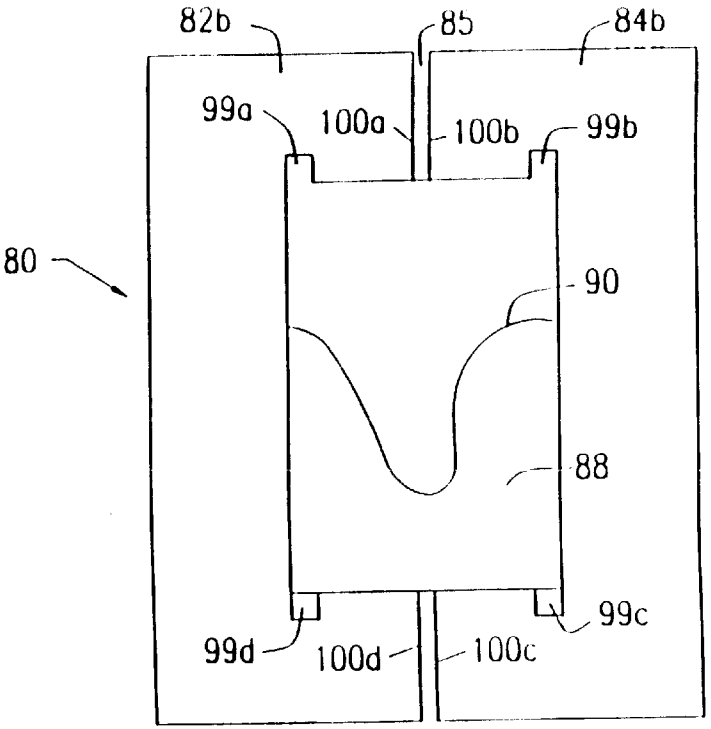
FIG. 11*e* is a top view of the page of FIG. 11*a* with the top sheet of cardboard removed.
Figure 11C:
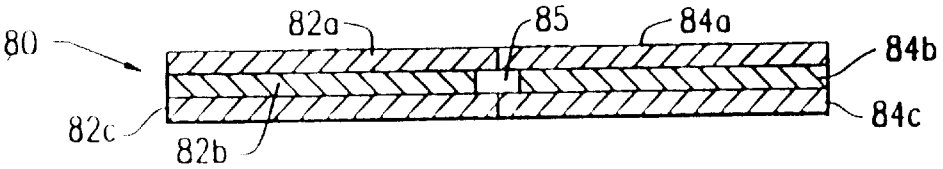
FIG. 11*c* is a cross-sectional view of the page of FIG. 11*a* taken along line A—A.
Figure 11D:
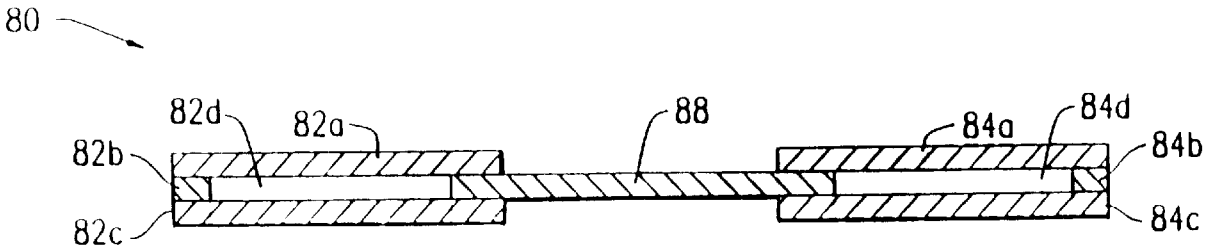
FIG. 11*d* is a cross-sectional view of the page of FIG. 11*b* taken along line B—B.

The use of telescoping means may be provided by any means known to those skilled in the art. In a preferred method, the page construction is shown in FIGS. 11*c*–11*e*. In FIG. 11*c* there is shown a cross-sectional view taken along line A—A of FIG. 11*a*. Each of the panels 82 and 84 of the page 80 is comprised of a three layered cardboard construction comprising sheets 82*a*, 82*b* and 82*c* for the first panel 82, and sheets 84*a*, 84*b* and 84*c* for the second panel 84. The track is cut into the tops of sheets 82*a* and 84*a*. A gap 85 is also provided between sheets 82*b* and 84*b*.

In FIG. 11*d* there is shown a cross-sectional view taken along line B—B of FIG. 11*b*. Panel 82 comprises a top sheet 82*a* and a bottom sheet 82*c* with a shortened middle sheet 82*b* and a recess 82*d* provided therebetween. Similarly, in panel 84 there is a top sheet 84*a* and a bottom sheet 84*c* with a shortened middle sheet 84*b* and recess 84*d* provided therebetween. A third panel 88 is provided which slidably fits into recesses 82*d* and 84*d* in the closed position. The third panel 88 is further provided with a track die cut onto its top surface. In this manner, the third panel 88 is adapted to slide out from panel 82 and panel 84 is adapted to slide out along panel 88 and still provide a continous track for the toy to move along.

Referring to FIG. 11*e*, there is shown a top view of page 80 with sheets 82*a* and 84*a* removed. From FIG. 11*e*, it can be seen that third panel 88 is further provided with stops 99*a*–*d* at each of its corners. Stops 99*a*–*d* act to prevent the third panel 88 from being completely removed from panel 82, and to prevent the panel 84 from sliding off the end of the third panel, by acting to engage with respective wall portions 10*a*–*d* of middle sheets 82*b* and 84*b*.

Figure 3:
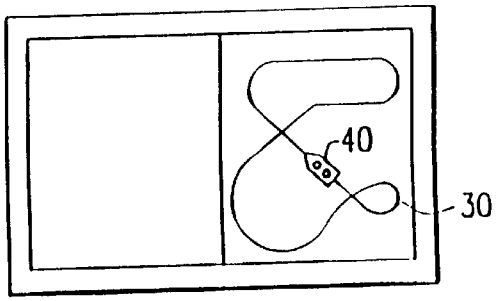
FIG. 3 depicts a top plan view of the book opened to a page including the track and the toy disposed on the track.
Figure 2:
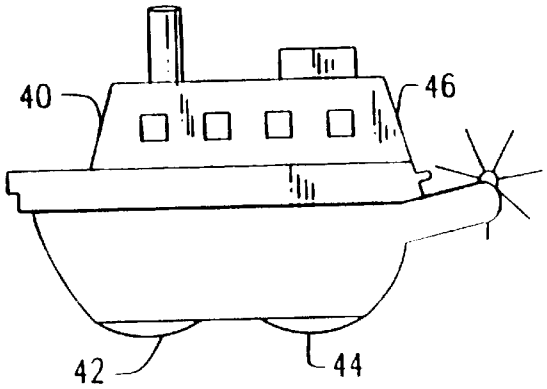
FIG. 2 depicts a side view of an example of the toy component of the invention.
Figure 4:
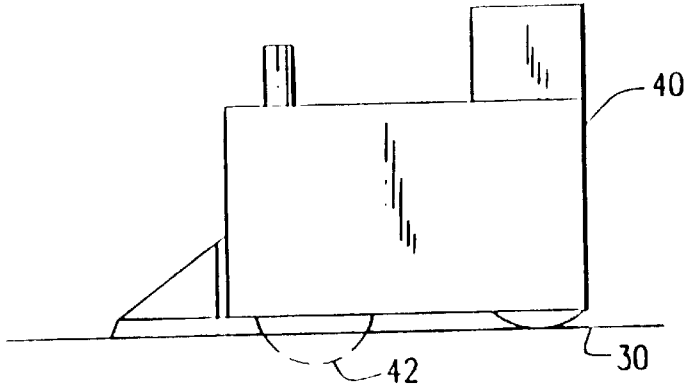
FIG. 4 depicts a side sectional view of the toy in functional engagement with the track disposed on the page with the engagement means and track groove shown in phantom.

Now referring to FIGS. 2–4, the toy or figure 40 comprises any toy or figure that is suitable for use in the interactive book of the present invention, preferably a toy or figure that is referenced in the text or illustration of the book 2 or fits within the context of the book 2. The toy or figure 40 comprises a body portion 46, a guide portion 42 and a balancing portion 44. Guide portion engages track 30 to retain toy or FIG. 40 along track 30. Guide portion 42 can be a wheel, pin or any suitable guide means compatible with track 30. The balancing portions 44 may also comprise wheels.

In a preferred embodiment toy or figure 40 is mechanized such as by spring-wound mechanism or any other known mechanical means. Additionally, the toy or figure 40 may be powered by an electrical power source such as a battery or solar panel. The wheels are powered by the power source, either mechanical or electrical, and propel the toy around the track. Such embodiments are well known to those skilled in the art.

In another preferred embodiment, the guide portion 42 of toy or figure 40 comprises a magnetic pickup or the like for use when track 30 comprises a magnetic strip.

In another preferred embodiment, book 2 has disposed in it a die cut hold or space (not shown) to accommodate at least one toy or figure for storage. In still a further embodiment, binding 15 is constructed with a space for accommodating at least one toy or figure 40 for storage. A bag or other suitable container may also be attached to the binding to store and package the toy with the book.

It is further contemplated by the present invention that a board game may be adapted to include a track or channel and movably engagable toy or figure in similar fashion to that described hereinabove with regard to a book. In this manner the toy or figure is preferably one which is readily associated with the subject matter of the game.

Various modifications to the above invention will become apparent to those skilled in the art, all of which are intended to fall within the spirit and scope of the present invention. All patents and publications referred to herein are hereby incorporated by reference.

What is claimed is:

1. An interactive book comprising:

a spine;

at least two pages each said page having a top edge, a bottom edge, an outer edge and an interior edge, said pages attaching to said spine along said interior edge of said page;

at least one of said pages comprising a means for increasing the trackage area along one or more of said top edge, said bottom edge or said outer edge;

a first track formed on said page comprising said means for increasing the trackage area and a second track formed on said means for increasing the trackage area of said page whereby said first track and said second track cooperate to provide increased trackage area;

wherein said means for increasing the trackage area of said page comprises a telescoping means to enlarge the area of said page, wherein said telescoping means includes said second track whereby said first track and said second track cooperate to provide increase trackage area; and a toy or figure wherein the toy or figure is movably engageable on said tracks to move continuously from said first track to said second track.

2. An interactive book comprising:

a spine;

at least two pages each said page having a top edge, a bottom edge, an outer edge and an interior edge, said pages attaching to said spine along said interior edge of said page;

at least one of said pages comprising a means for increasing the trackage area along one or more of said top edge, said bottom edge or said outer edge;

a first track formed on said page comprising said means for increasing the trackage area and a second track formed on said means for increasing the trackage area of said page whereby said first track and said second track cooperate to provide increased trackage area;

wherein said means for increasing the trackage area of said page comprises a fold out portion, wherein said fold out portion comprises said second track whereby said first track and said second track cooperate to provide increased trackage area; and a toy or figure wherein the toy or figure is movably engageable on said tracks to move continuously from said first track to said second track.

3. An interactive book according to claim 2 wherein the toy or figure is mechanized.

4. An interactive book according to claim 3 wherein the toy or figure is spring-wound.

5. An interactive book according to claim 2 wherein the track is a groove formed in said page.

6. An interactive book according to claim 2 wherein said page comprising a means for increasing the trackage area is a book cover.

7. An interactive book according to claim 2 wherein said toy or figure further comprises a means for guiding said toy or figure along said track.

8. An interactive book according to claim 7 wherein said track is a magnetic strip and said means for guiding said toy or figure is a magnetic pickup.

9. An interactive book according to claim 7 wherein said means for guiding said toy or figure is a pin.

10. An interactive book according to claim 9 wherein said means for guiding said toy or figure further comprises a flanged pin and said track further comprises a flanged groove wherein said flange of said pin is slidingly engageable with said flanged groove.

11. An interactive book according to claim 7 wherein said means for guiding said toy or figure further comprises a flanged recess and said track further comprises a flange which is slidingly engageable with said flanged recess.

12. An interactive book according to claim 2 wherein said book further comprises a means for storing said toy or figure.

* * * * *